US006941088B2

(12) United States Patent
Atsushi et al.

(10) Patent No.: US 6,941,088 B2
(45) Date of Patent: Sep. 6, 2005

(54) FIXING DEVICE, IMAGE FORMING APPARATUS, METHOD

(75) Inventors: Nakafuji Atsushi, Tokyo (JP); Kikuchi Hisashi, Kawasaki (JP); Fujita Takashi, Yokohama (JP); Kurotaka Shigeo, Sagamihara (JP); Yura Jun, Yokohama (JP); Baba Toshihiko, Funabashi (JP); Echigo Katsuhiro, Asaka (JP); Ikenoue Hirokazu, Inagi (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 10/634,900

(22) Filed: Aug. 6, 2003

(65) Prior Publication Data

US 2004/0086293 A1 May 6, 2004

(30) Foreign Application Priority Data

Aug. 6, 2002 (JP) ..... 2002-229260

(51) Int. Cl.[7] ..... G03G 15/20
(52) U.S. Cl. ..... 399/69
(58) Field of Search ..... 219/216, 470, 219/497; 320/151; 399/45, 69, 70, 82, 88, 90, 108

(56) References Cited

U.S. PATENT DOCUMENTS 6,542,705 B2 * 4/2003 Fujita et al. ..... 399/69

FOREIGN PATENT DOCUMENTS

| | | |
|---|---|---|
| JP | 3-5779 | 1/1991 |
| JP | 10-282821 | 10/1998 |
| JP | 2000-98799 | 4/2000 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A toner fixing device that includes a fixing member and a member formed opposite the fixing member so as to form a nip between the fixing member and the opposite member. The device is supplied with power from a main power source. A charger connects an electric double-layer capacitor to the main power source. A fixing member heater is powered by the electric double-layer capacitor and heats the fixing member. A controllable switch is disposed between the electric double-layer capacitor and the fixing member heater. A fixing member temperature sensor is in contact with the fixing member. A controller controls the switch such that the electric double-layer capacitor connects to or disconnects from the heater based on comparing a temperature sensed by the fixing member temperature sensor to a temperature threshold value so that a toner image is more efficiently fixed onto a recording medium passing through the nip.

22 Claims, 5 Drawing Sheets

FIXING DEVICE, IMAGE FORMING APPARATUS, METHOD

BACKGROUND OF THE INVENTION

1. Field of the Invention

The present invention relates to a fixing device, an image forming apparatus, and a fixing method.

2. Discussion of the Background

A background image forming apparatus (such as a copier, a facsimile, or a printer) fixes a toner image onto a recording medium with heat to make a copy of the image or to create a recorded medium. The toner image is fixed onto the recording medium by heating the toner image and the conveyed recording medium while the recording medium is being nipped, because the toner either melts or softens to allow the toner to permeate into the recording medium.

Japanese Published Unexamined Patent Application No. Hei 3-5779 shows an image forming apparatus including an upper pressing roller, an lower pressing roller, a main heater and a sub heater heating the upper pressing roller, a main power source supplying power to the main heater, and a rechargeable battery supplying power to the sub heater. This application further shows a charger configured to charge the rechargeable battery from the main power source, a switch to switch a electric double-layer capacitor so as to connect to or to disconnect from the heater, and a temperature sensor to sense the temperature of the upper pressing roller. This application furthermore shows a controller to control the switch switching the rechargeable battery to connect to or to disconnect from the sub heater based on comparing the sensed temperature by the temperature sensor to a threshold value of the temperature. In addition, Japanese Published Unexamined Patent Application No. Hei 2000-98799 and No. Hei 10-282821 show structures similar to those shown in JP 3-5779.

In these prior art references, the rechargeable battery can supply the power to the sub heater independent of the rating of the main power source. Thereby it is possible to rapidly heat the upper pressing roller independent of the rating of the main power source. However, these references are prone to rapid battery discharging and resultant multiple charging cycles which reduces the overall life of the battery.

SUMMARY OF THE INVENTION

It is an object of the present invention to provide a novel toner fixing device, image forming apparatus, and image forming method that result in increased battery life while providing tailored pre-heating functions.

It is another object of the present invention to provide a novel toner fixing device, image forming apparatus, and image forming method that optimizes power supplied from a battery to a heater in an image forming apparatus.

BRIEF DESCRIPTION OF THE DRAWINGS

A more complete appreciation of the present invention, and many of the attendant advantages thereof, will be readily obtained as the same becomes better understood by reference to the following detailed description when considered in connection with the accompanying drawings, wherein.

DETAILED DESCRIPTION OF THE PREFERRED EMBODIMENTS

Figure 1:
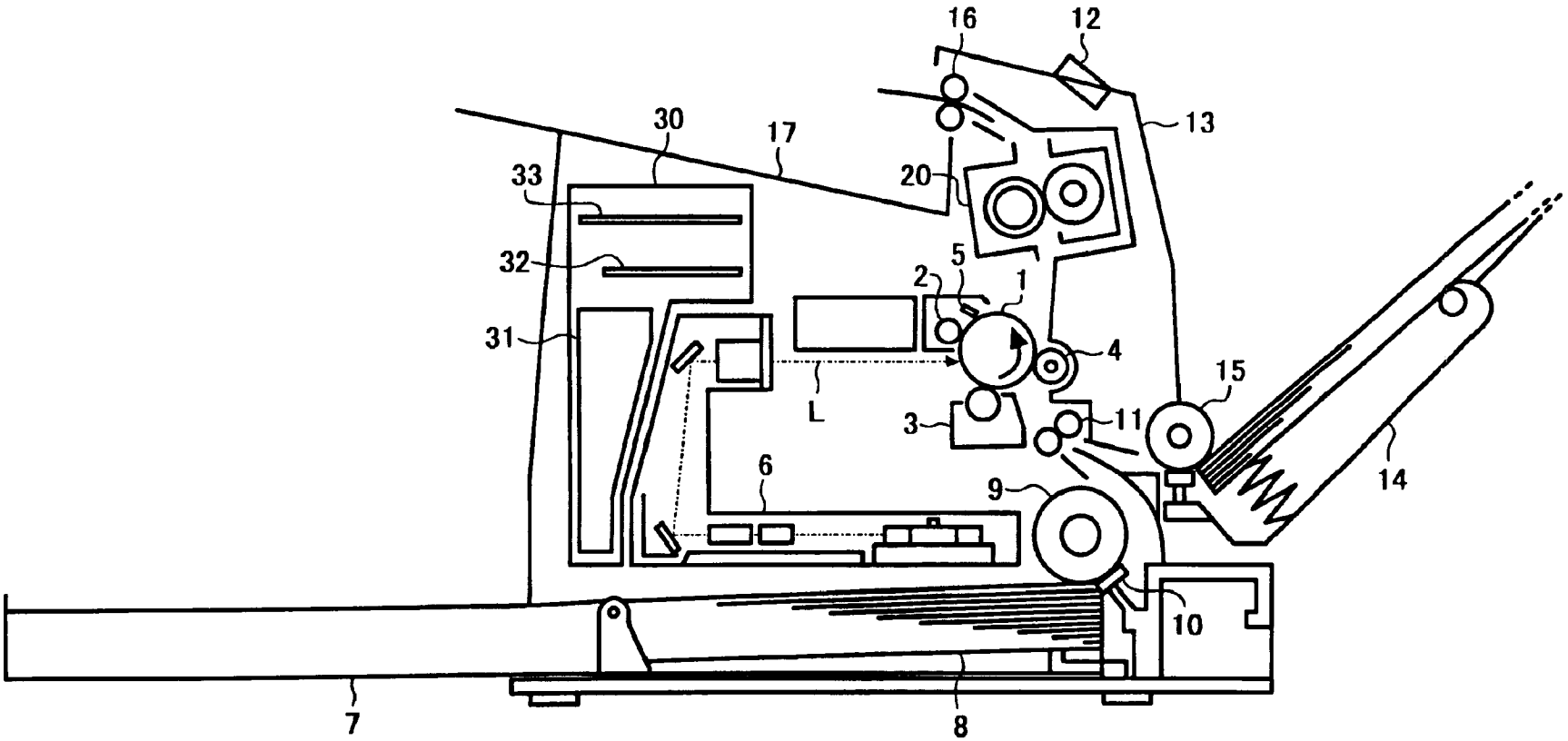
FIG. 1 is a schematic front view of an image forming apparatus according to the first through fourth embodiments of the present invention.

Hereinafter, the description of the embodiments of the present invention will be made with reference to the above-listed drawings, wherein like reference numerals designate identical or corresponding parts through the several views. This application incorporates by reference priority document Japanese patent application JP2002-229260 filed on Aug. 6, 2002.

FIG. 1 is a schematic front view showing an image forming apparatus according to the first through fourth embodiments of the present invention. The present invention is directed to other types of image forming apparatuses, as would be clearly understood by those of ordinary skill in the art. The image forming apparatus includes an image forming member 1 and an exposure unit 6. A charging member 2, a developing unit 3, a transfer member 4, and a cleaning member 5 are arranged around the image forming member 1. The charging member 2 and the developing unit 3 are arranged so that an irradiated light L from the exposure unit 6 passes between them so as to exposure the surface of image forming member 1.

According to this structure, the irradiated light L forms a static potential image on the surface of image forming member 1, after charging member 2 equally charges the surface of image forming member 1. Then developing member 3 makes the static potential image into a visible static image as a toner image. Further, cleaning member 5 removes the residual toner from image forming member 1 while in contact with image forming member 1, then a discharge member (not illustrated) initializes an electric potential on image forming member 1.

A sheet tray 7 with an intermediate plate 8 holding plural recording mediums is arranged at a lower part of the image forming apparatus. A feeding roller 9 and a separating member 10 are arranged about the sheet tray 7. The plural recording mediums are pressed up to feed roller 9 by a drive (not illustrated). Feed roller 9 feeds the upper recording medium on intermediate tray 8 while rotating and separating member 10 sequentially separates one recording medium from the stack of plural recording mediums.

A pair of resist rollers 11 is arranged above feeding roller 9. The pair of resist rollers 11 temporally stop and send the recording medium synchronous with the toner image forming operations performed by the image forming member 1. The sent recording medium is transferred from image forming member 1 by transfer member 4.

A fixing device 20 which fixes the toner image onto the recording medium by heat and pressure is located above the image forming member 1. A pair of ejecting rollers 16, which eject the recording medium, are located about the fixing device 20. A tray 17 is located at an upper part of the image forming apparatus 1. The tray 17 stacks the ejected recording medium, with the surface containing the toner image facing downward on the tray 17.

Figure 2:
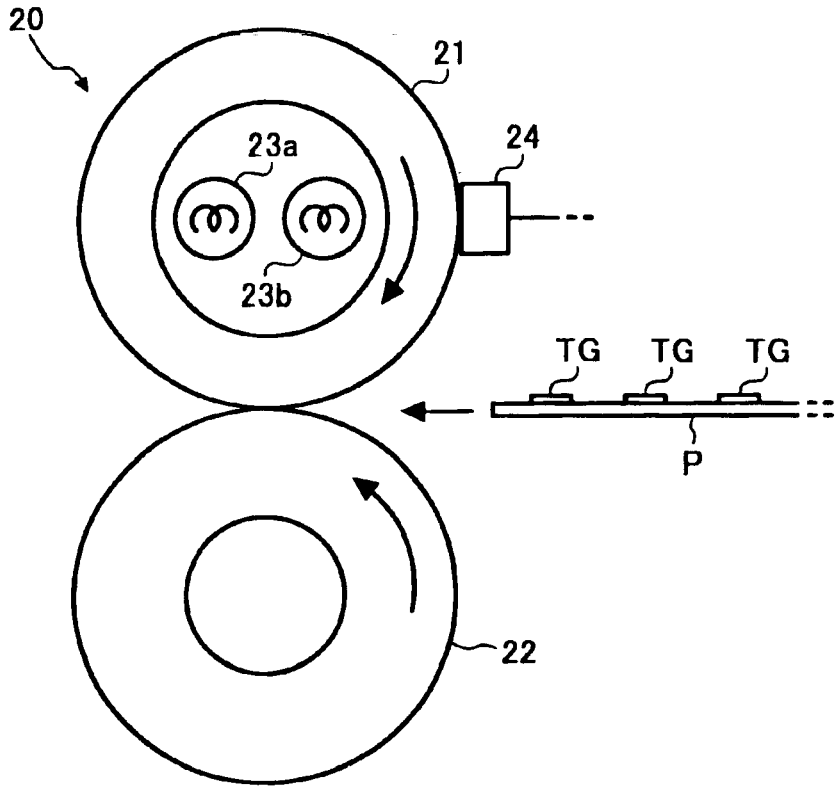
FIG. 2 is a schematic front view of a part of a fixing device in the first through fourth embodiments.

FIG. 2 is a schematic front view showing a part of the fixing device 20 of the first through fourth embodiments. Fixing device 20 includes a fixing roller 21 as a fixing member, a pressing roller 22 as an opposite member formed opposite fixing roller 21, and a temperature sensor 24 configured to sense the surface temperature of fixing roller 21. Temperature sensor 24 may sense the surface temperature of pressing roller 22. Fixing roller 21 includes two heaters 23*a*, 23*b* configured to heat fixing roller 21. Pressing roller 22 includes an elastic layer such as silicone rubber and presses fixing roller 21 by a pressing source (not illustrated). Fixing roller 21 and pressing roller 4 form a nip between them, and toner image TG is fixed onto the recording medium P while passing through the nip.

Figure 3:
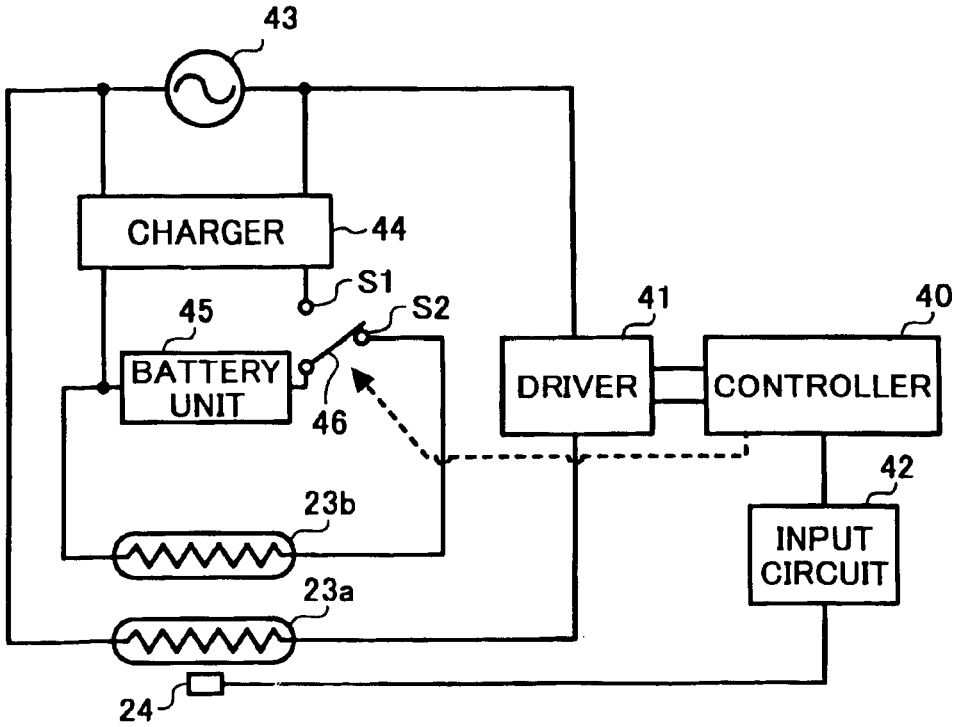
FIG. 3 is a control block diagram of the first through fourth embodiments.

FIG. 3 is a control block view of the first through fourth embodiments. The image forming apparatus includes a controller 40, a driver 41, an input circuit 42, and a commercial power source 43 as a main power source supplying power to heater 23*a* through driver 41. Input circuit 42 inputs a signal from temperature sensor 24 and outputs a signal according to the signal input from the temperature sensor 24. Commercial power source 43 supplies power to a battery unit 45 through a charger 44 and a switch 46 with a port S1 and a port S2. Charger 44 converts AC power supplied from commercial power source 43 to DC power, then charges battery unit 45 with the converted DC power. Battery unit 45 supplies power to heater 23*b*. Switch 46 connects battery unit 45 to charger 44, and disconnects battery unit 45 from heater 23*b* when switching to port S1. Switch 46 connects battery unit 45 to heater 23*b* and disconnects battery unit 45 from charger 44 when switching to port S2. Switch 46 may include another port disconnecting battery unit 45 from both charger 44 and heater 23*b*.

Controller 40 controls driver 41 to be in an OFF state so as not to supply power to the heater 23*a* during a standby time. Controller 40 controls the on-off operations of driver 41 based on comparing the temperature sensed by temperature sensor 24 to a threshold value of temperature during a ramp-up period, and while plural recording medium continuously pass through the nip. The threshold value of the temperature is determined based on the necessary temperature to fix the toner image onto the recording medium. In particular, controller 40 controls driver 41 to an ON state so as to supply power to heater 23*a* when the temperature is less than the threshold value, and controls driver 41 to an OFF state so as not to supply power to heater 23*a* when the temperature is greater than the threshold value.

Further controller 40 controls switch 46 to switch to port S1 or port S2 based on comparing the temperature sensed by the temperature sensor 24 to the threshold value of the temperature while plural recording medium continuously pass the nip. In particular, controller 40 controls battery unit 45 to connect heater 23*b* when the temperature is less than the threshold value, and controls battery unit 45 to disconnect heater 23*b* when the temperature is greater than the threshold value. Therefore the surface temperature of fixing roller 21 is almost kept the threshold value of the temperature while plural recording medium continuously passing the nip. During the standby time and ramp-up period, controller 40 controls switch 46 to switch to port S1 independently of the surface temperature of fixing roller 21.

Further in this embodiment, battery unit 45 includes an electric double-layer capacitor. The electric double-layer capacitor can supply higher-density power of at least three times than a lead acid battery and a nickel cadmium battery; thereby it can supply large power in a short time. Therefore the temperature of heater 23*b* can rise rapidly.

Advantageously, the electric double-layer capacitor charges and discharges by physical absorption of ions, not by chemical reaction. Thus, the capacitor's lifetime is less vulnerable to a reduction in life span resulting from repeated charging and discharging than would be a normal chemical reaction battery. Thus, the lifetime of battery unit 45 that is configured to be switched based on comparing the temperature sensed by the temperature sensor 24 to a temperature threshold value is longer when the battery unit 45 is equipped with an electric double-layer capacitor than a conventional battery unit that is equipped with a conventional battery.

Further charger 44 and battery unit 45 are preferably not mounted on fixing device 20. Thereby charger 44 and battery unit 45 can be detachable from the image forming apparatus independently from fixing device 20. Therefore, it is not necessary to detach the electric double-layer capacitor with the long lifetime from the image forming apparatus when the fixing device 20 is detached from the image forming apparatus for maintenance or other purposes.

Figure 4A:
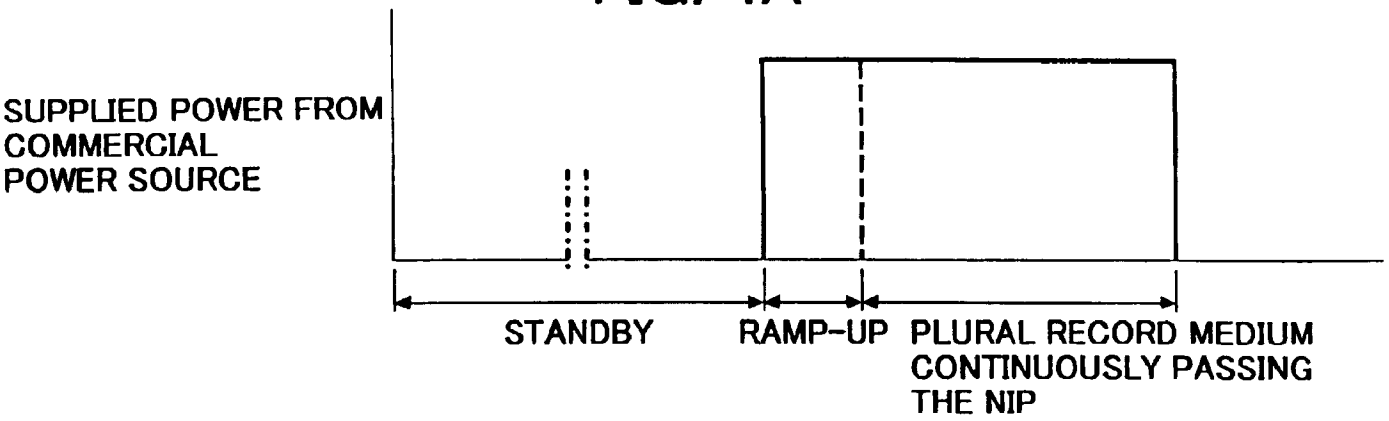
FIG. 4A is a timing diagram for supplying power from a commercial power source to a heater in the first through fourth embodiments.
Figure 4B:
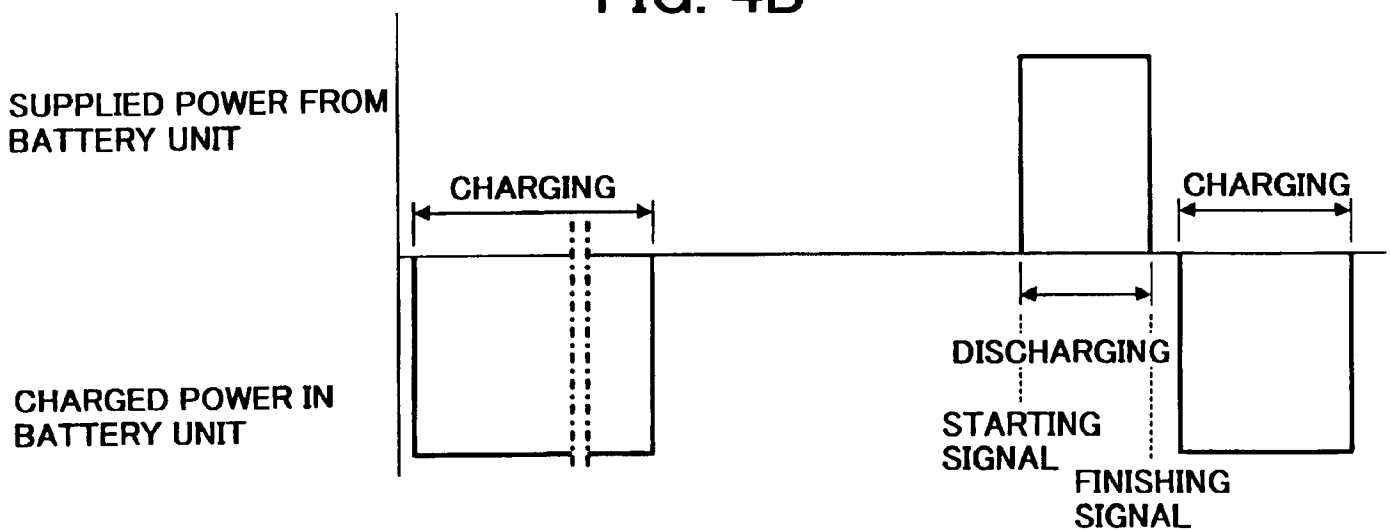
FIG. 4B is a timing diagram for supplying power from a battery unit to a heater in the first through fourth embodiments.

FIG. 4A is a timing diagram view showing supplied power from the commercial power source 43 to the heater 23*a*. FIG. 4B is a timing diagram view showing supplied power from the battery unit 45 to the heater 23*b*.

During a standby time, controller 40 controls driver 41 such that commercial power source 43 does not supply power to heater 23*a*. Controller 40 also controls switch 46 such that charger 44 charges battery unit 45 until the voltage of battery unit 45 reaches a predetermined voltage.

During the ramp-up period, controller 40 controls driver 41 such that commercial power source 43 supplies power to heater 23*a*. Controller 40 also controls switch 46 such that battery unit 45 disconnects heater 23*b*.

While plural recording medium continuously pass through the nip, controller 40 controls driver 41 such that commercial power source 43 supplies power to heater 23*a*. Controller 40 also outputs a starting signal to switch 46 when the temperature sensed by temperature sensor 24 is less than a threshold value of the recording medium temperature. Switch 46 connects battery unit 45 to heater 23*b* based on the starting signal, then battery unit 45 starts supplying power to heater 23*b*. Controller 40 outputs a finishing signal to switch 46 when the temperature sensed by temperature sensor 24 is greater than a threshold value. Switch 46 disconnects battery unit 45 from heater 23*b* based on a finishing signal, then battery unit 45 finishes supplying power to heater 23*b*.

In the FIGS. 4A, 4B, the starting signal and the finishing signal are each output once while plural recording medium continuously pass through the nip. The starting signal and the finishing signal each can be repeatedly output more than once when the number of the recording medium is large. However, as explained previously, although battery unit 45 is repeatedly switched to discharge or charge, the lifetime of battery unit 45 is longer than conventional battery units because battery unit 45 includes the electric double-layer capacitor.

In a second embodiment of the present invention, controller 40 outputs the starting signal after the temperature sensed by temperature sensor 24 continuously decreases during a predetermined period, and before the sensed temperature continuously falls below a temperature necessary to fix the toner image onto the recording medium, said drop in temperature caused in part by heat being absorbed from the fixing member by the passing recording medium. Switch 46 connects battery unit 45 to heater 23*b* based on the starting signal, then battery unit 45 starts supplying power to heater 23*b*. Meanwhile controller 40 outputs the finishing signal when the temperature sensed by temperature sensor 24 is greater than a temperature threshold value. Switch 46 disconnects battery unit 45 from heater 23*b* based on the finishing signal, then battery unit 45 finishes supplying power to heater 23*b*.

Thereby controller 40 is prevented from unnecessarily outputting the starting signal multiple times that might be caused by transitional changes in temperature on the fixing roller 21. Therefore the lifetime of battery unit 45 is longer than conventional battery units because battery unit 45 is prevented from being repeatedly switched to discharge or not. Thereby in this second embodiment, battery unit 45 may not necessarily include the electric double-layer capacitor.

In addition, the toner image is more reliably fixed onto the recording medium, because heater 23*b* can heat fixing roller 21 before the temperature on fixing roller 21 falls below the necessary temperature to fix the toner image onto the recording medium, said drop in temperature caused in part by heat being absorbed from the fixing member by the passing recording medium.

In the third embodiment of the invention, controller 40 outputs a starting signal when a decreasing rate of the temperature sensed by temperature sensor 24 is over a predetermined decreasing rate of the temperature, and before the sensed temperature continuously falls below the necessary temperature to fix the toner image onto the recording medium. Switch 46 connects battery unit 45 to connect heater 23*b* based on the starting signal, then battery unit 45 starts supplying power to heater 23*b*. Meanwhile controller 40 outputs the finishing signal when the temperature sensed by temperature sensor 24 is greater than a threshold value of the temperature. Switch 46 switches battery unit 45 to disconnect from heater 23*b* based on the finishing signal, then battery unit 45 finishes supplying power to heater 23*b*.

Thereby controller 40 is prevented from outputting the starting signal many times that might be caused by the transitional changes in the temperature on fixing roller 21. Therefore the lifetime of battery unit 45 is longer than conventional battery units because battery unit 45 is prevented from being repeatedly switched to discharge or not. Thereby in this modification, battery unit 45 may not necessarily include the electric double-layer capacitor.

In addition in this modification, the toner image is more reliably fixed onto the recording medium, because heater 23*b* can heat fixing roller 21 before the temperature on fixing roller 21 falls below the necessary temperature to fix the toner image onto the recording medium, said drop in temperature caused in part by heat being absorbed from the fixing member by the passing recording medium.

In the fourth embodiment, controller 40 calculates a heat load based on the number or a kind of the recording medium. Then controller 40 outputs the starting signal when the calculated heat load is greater than the predetermined heat load, and before the sensed temperature continuously falls below the necessary temperature to fix the toner image onto the recording medium. Switch 46 connects battery unit 45 to connect heater 23*b* based on the starting signal, then battery unit 45 starts charging to heater 23*b*. Meanwhile controller 40 outputs a finishing signal when the temperature sensed by temperature sensor 24 is greater than a threshold value of the temperature. Switch 46 switches battery unit 45 to connect to heater 23*b* based on the finishing signal, then battery unit 45 finishes supplying power to heater 23*b*.

Thereby controller 40 is prevented from outputting the starting signal many times that might be caused by transitional changes in the temperature on fixing roller 21. Therefore the lifetime of battery unit 45 is longer than conventional battery units because battery unit 45 is prevented from being repeatedly switched to discharge or charge. Thereby in the fourth embodiment, battery unit 45 may not necessarily include the electric double-layer capacitor.

In addition, in the fourth embodiment the toner image is more reliably fixed onto the recording medium because heater 23*b* can heat fixing roller 21 before the temperature on fixing roller 21 falls below the temperature necessary to fix the toner image onto the recording medium, said drop in temperature caused in part by heat being absorbed from the fixing member by the passing recording medium.

Further, controller 40 preferably holds data showing the relation between the heat load and the number and/or type of the recording medium. Controller 40 thereby calculates the heat load and further rewrites the data based on the sensed temperature. Thus, heater 23*b* can be controlled to heat fixing roller 21 at the appropriate timing.

Figure 5A:
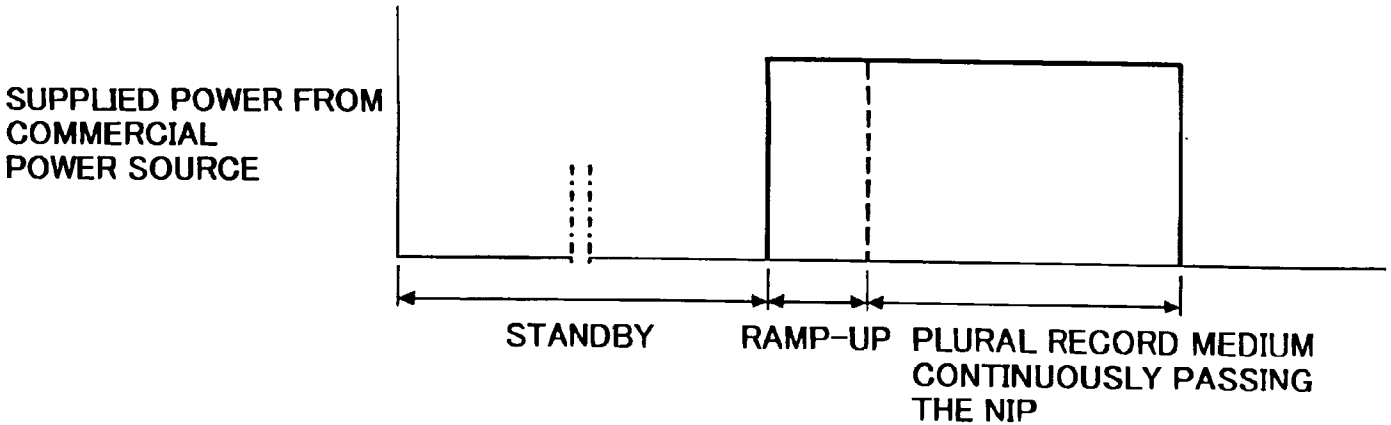
FIG. 5A is a timing diagram for supplying power from a commercial power source to the heater in the fifth embodiment of the present invention.
Figure 5B:
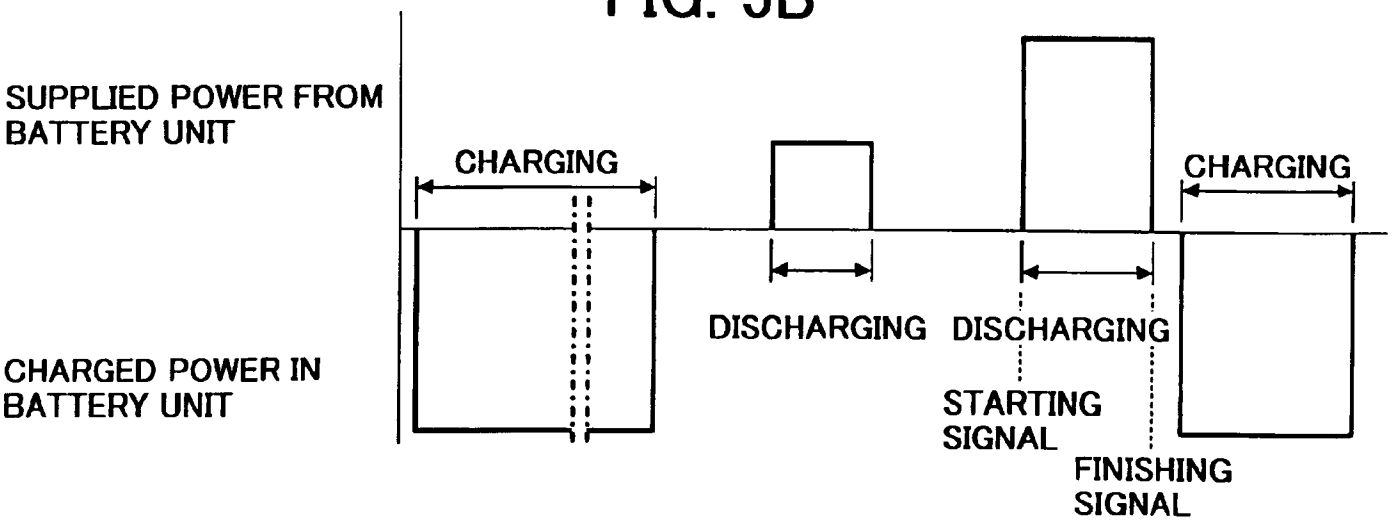
FIG. 5B is a timing diagram for supplying power from a battery unit to the heater in the fifth embodiment.

FIG. 5A is a timing diagram view showing supplied power from commercial power source 43 to heater 23*a* in a fifth embodiment of the present invention. FIG. 5B is a timing diagram view showing supplied power from battery unit 45 to heater 23*b* in the fifth embodiment.

In the fifth embodiment, battery unit 45 can supply power in two modes of operations: limited and non-limited power.

In the limited power mode of operation, controller 40 outputs a starting signal during a ramp-up period. Switch 46 connects battery unit 45 to heater 23*b* based on the starting signal, then battery unit 45 starts supplying limited power to heater 23*b*. Meanwhile controller 40 outputs a finishing signal after a predetermined period after outputting the starting signal. Switch 46 disconnects battery unit 45 to heater 23*b* based on the finishing signal, then battery unit 45 finishes supplying the limited power to heater 23*b*.

During non-limited operations, plural recording medium are continuously passing through the nip. Controller 40 outputs the starting signal and the finishing signal to switch 46 according to each condition mentioned above. Switch 46 connects battery unit 45 to heater 23*b* based on the starting signal, then battery unit 45 starts supplying the non-limited power to heater 23*b*. Switch 46 disconnects battery unit 45 from heater 23*b* based on the finishing signal, then battery unit 45 finishes supplying the non-limited power to heater 23*b*.

Thereby it is possible to raise the temperature on fixing roller 21 rapidly during the limited operations, while conserving battery power to later supply to power to heater 23*b* while plural recording medium are continuously passing through the nip. In this embodiment, battery unit 45 may not necessarily include the electric double-layer capacitor.

Figure 6:
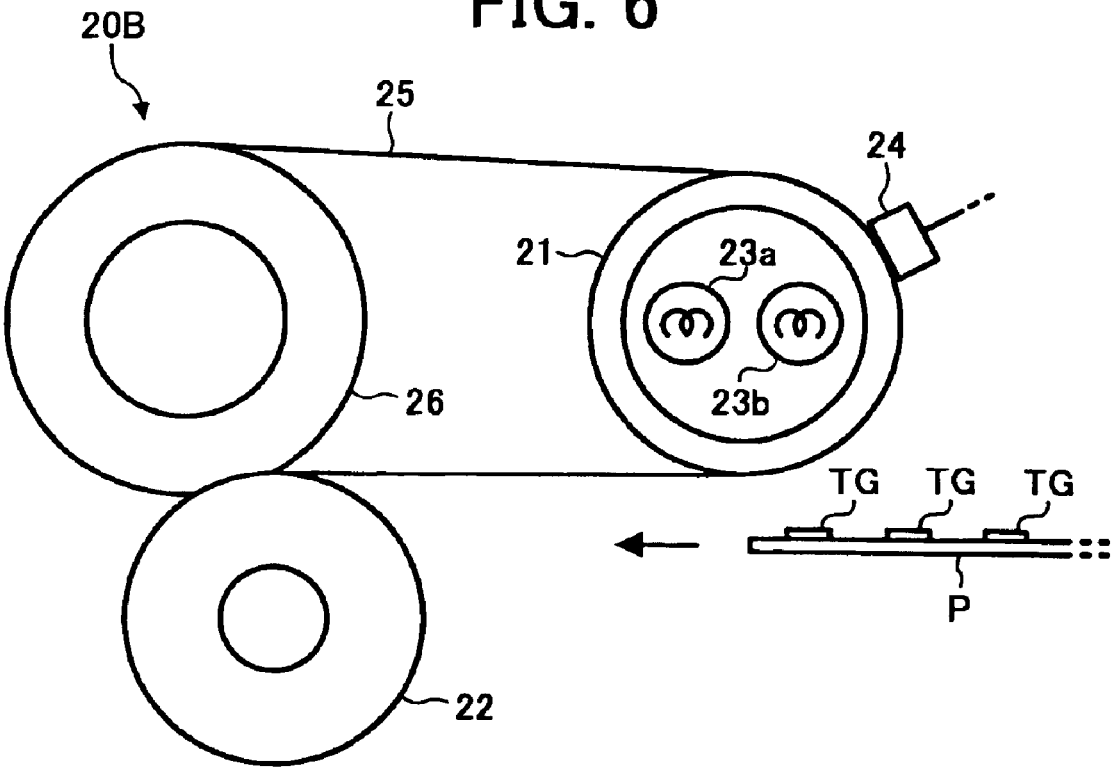
FIG. 6 is a schematic front view of a part of a fixing device in the sixth embodiment of the present invention.

FIG. 6 is a schematic front view showing the substantial part of a fixing device 20B in a sixth embodiment of the present invention. Fixing device 20B includes a fixing belt 25 as a fixing member, a fixing roller 21 heating fixing belt 25, a supporting member 26 supporting fixing belt 25 and fixing roller 21. Fixing device 20B further includes pressing roller 22 opposite supporting roller 26 and fixing belt 25. Temperature sensor 24 is configured to sense the surface temperature of fixing belt 25. Fixing roller 21 includes two heaters 23*a*, 23*b* configured to heat fixing roller 21. Pressing roller 22 includes an elastic layer such as silicone rubber and nips to press fixing belt 25 together with supporting roller 26 by a pressing source (not illustrated). Fixing belt 25 and pressing roller 4 form the nip between them so that the toner image TG is fixed onto the recording medium P when passing through the nip.

What is claimed is:

1. A toner fixing device, comprising:

a fixing member;

an opposite member formed opposite said fixing member so as to form a nip between said fixing member and said opposite member;

a main power source;

an electric double-layer capacitor;

a charger connecting said electric double-layer capacitor to said main power source;

a fixing member heater connected to said electric double-layer capacitor;

a switch disposed between said electric double-layer capacitor and said fixing member heater, said switch configured to controllably connect and disconnect said electric double-layer capacitor and said fixing member heater;

a fixing member temperature sensor in contact with said fixing member; and a controller configured to control said switch such that said electric double-layer capacitor connects to or disconnects from said heater based on comparing a temperature sensed by said fixing member temperature sensor to a temperature threshold value while plural recording medium continuously pass said nip, wherein a toner image is fixed onto a recording medium passing through said nip.

2. The toner fixing device according to claim 1, wherein said main power source is also connected to said heater.

3. The toner fixing device according to claim 2, said fixing member heater comprising:

a first fixing member heater supplied with power from said electric double-layer capacitor; and a second fixing member heater supplied with power from said main power source.

4. A toner fixing device, comprising:

a fixing member;

an opposite member formed opposite said fixing member so as to form a nip between said fixing member and said opposite member;

a main power source;

a battery unit;

a charger connecting said battery unit to said main power source;

a fixing member heater connected to said battery unit;

a switch disposed between said battery unit and said fixing member heater, said switch configured to controllably connect or disconnect said battery unit and said fixing member heater;

a fixing member temperature sensor connected to said fixing member; and a controller configured to control said switch such that said battery unit connects to said fixing member heater after a sensed fixing member temperature continuously decreases during a predetermined period, wherein a toner image is fixed onto a recording medium while passing through said nip.

5. A toner fixing device, comprising:

a fixing member;

an opposite member formed opposite said fixing member so as to form a nip between said fixing member and said opposite member;

a main power source;

a battery unit;

a charger connecting said battery unit to said main power source;

a fixing member heater connected to said battery unit;

a switch disposed between said battery unit and said fixing member heater, said switch configured to controllably connect or disconnect said battery unit and said fixing member heater;

a fixing member temperature sensor connected to said fixing member; and a controller configured to control said switch such that said battery unit connects to said heater when a sensed rate of decreasing temperature exceeds a predetermined rate of decreasing temperature, wherein a toner image is fixed onto a recording medium while passing through said nip.

6. A toner fixing device, comprising:

a fixing member;

an opposite member formed opposite said fixing member so as to form a nip between said fixing member and said opposite member;

a main power source;

a battery unit;

a charger connecting said battery unit to said main power source;

a fixing member heater connected to said battery unit;

a switch disposed between said battery unit and said fixing member heater, said switch configured to controllably connect or disconnect said battery unit and said fixing member heater; and a controller configured to calculate a heat load based on at least one of a number and a type of recording medium passing through the nip, and to control said switch based on the calculated heat load, wherein a toner image is fixed onto a recording medium while passing through said nip.

7. The toner fixing device according to claim 6, further comprising:

a fixing member temperature sensor connected to said fixing member, wherein said controller further calculates said heat load based on a sensed temperature.

8. A toner fixing device, comprising:

a fixing member;

an opposite member formed opposite said fixing member so as to form a nip between said fixing member and said opposite member;

a main power source;

a battery unit configured to operate in a limited mode of operation and an unlimited mode of operation;

a charger connecting said battery unit to said main power source;

a fixing member heater connected to said battery unit; and a controller configured to control said battery unit, wherein a toner image is fixed onto a recording medium while passing through said nip, and said controller controls said battery unit to operate in said limited mode of operation during a ramp-up time before fixing images onto said recording medium.

9. The toner fixing device according to claim 8, wherein said controller controls said battery unit to operate in said unlimited mode of operation while plural recording medium continuously pass through said nip.

10. In an image forming apparatus, the improvement comprising:

a toner fixing device comprising a fixing member, an opposite member formed opposite said fixing member so as to form a nip between said fixing member and said opposite member, a main power source, an electric double-layer capacitor, a charger connecting said electric double-layer capacitor to said main power source, a fixing member heater connected to said electric double-layer capacitor, a switch disposed between said electric double-layer capacitor and said fixing member heater, said switch configured to controllably connect and disconnect said electric double-layer capacitor and said fixing member heater, a fixing member temperature sensor in contact with said fixing member, and a controller configured to control said switch such that said electric double-layer capacitor connects to or disconnects from said heater based on comparing a temperature sensed by said fixing member temperature sensor to a temperature threshold value while plural recording medium continuously pass said nip, wherein a toner image is fixed onto a recording medium passing through said nip.

11. In an image forming apparatus, the improvement comprising:

a toner fixing device comprising a fixing member, an opposite member formed opposite said fixing member so as to form a nip between said fixing member and said opposite member, a main power source, a battery unit, a charger connecting said battery unit to said main power source, a fixing member heater connected to said battery unit, a switch disposed between said battery unit and said fixing member heater, said switch configured to controllably connect or disconnect said battery unit and said fixing member heater, a fixing member temperature sensor connected to said fixing member, and a controller configured to control said switch such that said battery unit connects to said fixing member heater after a sensed fixing member temperature continuously decreases during a predetermined period, wherein a toner image is fixed onto a recording medium while passing through said nip.

12. In an image forming apparatus, the improvement comprising:

a toner fixing device comprising a fixing member, an opposite member formed opposite said fixing member so as to form a nip between said fixing member and said opposite member, a main power source, a battery unit, a charger connecting said battery unit to said main power source, a fixing member heater connected to said battery unit, a switch disposed between said battery unit and said fixing member heater, said switch configured to controllably connect or disconnect said battery unit and said fixing member heater, a fixing member temperature sensor connected to said fixing member, and a controller configured to control said switch such that said battery unit connects to said heater when a sensed rate of decreasing temperature exceeds a predetermined rate of decreasing temperature, wherein a toner image is fixed onto a recording medium while passing through said nip.

13. In an image forming apparatus, the improvement comprising:

a toner fixing device comprising a fixing member, an opposite member formed opposite said fixing member so as to form a nip between said fixing member and said opposite member, a main power source, a battery unit, a charger connecting said battery unit to said main power source, a fixing member heater connected to said battery unit, a switch disposed between said battery unit and said fixing member heater, said switch configured to controllably connect or disconnect said battery unit and said fixing member heater, and a controller configured to calculate a heat load based on at least one of a number and a type of recording medium passing through the nip, and to control said switch based on the calculated heat load, wherein a toner image is fixed onto a recording medium while passing through said nip.

14. In an image forming apparatus, the improvement comprising:

a toner fixing device comprising a fixing member, an opposite member formed opposite said fixing member so as to form a nip between said fixing member and said opposite member, a main power source, a battery unit configured to operate in a limited mode of operation and an unlimited mode of operation, a charger connecting said battery unit to said main power source, a fixing member heater connected to said battery unit, and a controller configured to control said battery unit, wherein a toner image is fixed onto a recording medium while passing through said nip, and said controller controls said battery unit to operate in said limited mode of operation during a ramp-up time before fixing images onto said recording medium.

15. A method for fixing a toner image onto a recording medium, comprising:

charging an electric double-layer capacitor;

sensing a temperature of a toner fixing member; and connecting and disconnecting said electric double-layer capacitor and a fixing member heater based on comparing a sensed fixing member temperature to a threshold temperature value while plural recording medium continuously pass said nip.

16. A method for fixing a toner image onto a recording medium, comprising:

charging a battery unit from a main power source;

sensing a fixing member temperature; and connecting and disconnecting said battery unit and a fixing member heater based on comparing a duration of decreasing sensed fixing member temperature with a threshold time period.

17. A method for fixing a toner image onto a recording medium, comprising:

charging a battery unit from a main power source;

sensing a fixed member temperature; and connecting and disconnecting said battery and a fixing member heater based on comparing a rate of decreasing sensed temperature with a threshold rate of decreasing temperature.

18. A method for fixing a toner image onto a recording medium, comprising:

charging a battery unit from a main power source;

sensing a fixing member temperature;

calculating a heat load based on at least one of a number or type of recording medium; and connecting and disconnecting said battery unit and a fixing member heater based on a calculated heat load.

19. A toner fixing device, comprising:

means for charging an electric double-layer capacitor;

means for sensing a temperature of a toner fixing member; and means for connecting and disconnecting said electric double-layer capacitor and a fixing member heater based on comparing a sensed fixing member temperature to a threshold temperature value while plural recording medium continuously pass said nip.

20. A toner fixing device, comprising:

means for charging a battery unit from a main power source;

means for sensing a fixing member temperature; and means for connecting and disconnecting said battery unit and a fixing member heater based on comparing a duration of decreasing sensed fixing member temperature with a threshold time period.

21. A toner fixing device, comprising:

means for charging a battery unit from a main power source;

means for sensing a fixing member temperature; and means for connecting and disconnecting said battery and a fixing member heater based on comparing a rate of decreasing sensed temperature with a threshold rate of decreasing temperature.

22. A toner fixing device, comprising:

means for charging a battery unit from a main power source;

means for sensing a fixing member temperature;

means for calculating a heat load based on at least one of a number or type of recording medium; and means for connecting and disconnecting said battery unit and a fixing member heater based on a calculated heat load.

* * * * *

UNITED STATES PATENT AND TRADEMARK OFFICE

CERTIFICATE OF CORRECTION

PATENT NO. : 6,941,088 B2
DATED : September 2005
INVENTOR(S) : Nakafuji et al.

It is certified that error appears in the above-identified patent and that said Letters Patent is hereby corrected as shown below:

Title page,
Item [75], should read:
-- Inventors: Atsushi Nakafuji, Tokyo (JP); Hisashi Kikuchi, Kawasaki (JP); Takashi Fujita, Yokohama (JP); Shigeo Kurotaka, Sagamihara (JP); Jun Yura, Yokohama (JP); Toshihiko Baba, Funabashi (JP); Katsuhiro Echigo, Asaka (JP); Hirokazu Ikenoue, Inagi (JP) --.
Item [12], should read:
-- Nakafuji et al. --.

Signed and Sealed this

Third Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,941,088 B2
DATED : September 6, 2005
INVENTOR(S) : Nakafuji et al.

It is certified that error appears in the above-identified patent and that said Letters Patent is hereby corrected as shown below:

Title page,
Item [75], should read:
-- Inventors: Atsushi Nakafuji, Tokyo (JP); Hisashi Kikuchi, Kawasaki (JP); Takashi Fujita, Yokohama (JP); Shigeo Kurotaka, Sagamihara (JP); Jun Yura, Yokohama (JP); Toshihiko Baba, Funabashi (JP); Katsuhiro Echigo, Asaka (JP); Hirokazu Ikenoue, Inagi (JP) --.
Item [12], should read:
-- Nakafuji et al. --.

This certificate supersedes Certificate of Correction issued January 3, 2006.

Signed and Sealed this

Thirty-first Day of January, 2006

JON W. DUDAS
*Director of the United States Patent and Trademark Office*